US009108245B2

(12) United States Patent
Steiner et al.

(10) Patent No.: US 9,108,245 B2
(45) Date of Patent: Aug. 18, 2015

(54) SLIDING CLOSURE FOR A RECEPTACLE CONTAINING MOLTEN METAL

(75) Inventors: Benno Steiner, Nebikon (CH); Werner Keller, Steinhausen (CH); Urs Truttmann, Baar (CH)

(73) Assignee: Stopinc Aktiengesellschaft, Hunenberg (CH)

( * ) Notice: Subject to any disclaimer, the term of this patent is extended or adjusted under 35 U.S.C. 154(b) by 445 days.

(21) Appl. No.: 12/988,058

(22) PCT Filed: Apr. 3, 2009

(86) PCT No.: PCT/EP2009/002461

§ 371 (c)(1),
(2), (4) Date: Feb. 11, 2011

(87) PCT Pub. No.: WO2009/127333

PCT Pub. Date: Oct. 22, 2009

(65) Prior Publication Data

US 2011/0127265 A1 Jun. 2, 2011

(30) Foreign Application Priority Data

Apr. 17, 2008 (CH) ..... 0603/08

(51) Int. Cl.

| | |
|---|---|
| ***B22D 41/22*** | (2006.01) |
| ***B65D 55/00*** | (2006.01) |
| ***B22D 41/38*** | (2006.01) |
| ***B22D 41/24*** | (2006.01) |
| ***B22D 41/28*** | (2006.01) |
| *B22D 41/00* | (2006.01) |
| *B65D 5/72* | (2006.01) |

(52) U.S. Cl.

CPC ..... *B22D 41/22* (2013.01); *B22D 41/24* (2013.01); *B22D 41/28* (2013.01); *B22D 41/38* (2013.01); *B65D 5/723* (2013.01)

(58) Field of Classification Search

CPC ..... B65D 5/723; B65D 55/00; B22D 41/22; B22D 41/24; B22D 41/28; B22D 41/38

USPC ..... 222/590–607

See application file for complete search history.

(56) References Cited

U.S. PATENT DOCUMENTS

| | | | | |
|---|---|---|---|---|
| 5,173,199 | A * | 12/1992 | Bruckner et al. | 222/600 |
| 5,429,342 | A * | 7/1995 | Pfyl et al. | 266/236 |
| 5,698,129 | A * | 12/1997 | Keller et al. | 222/600 |

* cited by examiner

*Primary Examiner* — Lois Zheng
(74) *Attorney, Agent, or Firm* — Brian Roffe

(57) ABSTRACT

Sliding closure for a receptacle containing molten metal includes a housing frame that can be fastened to a spout of the receptacle, a first refractory base plate and a sliding unit having a refractory sliding plate that is sealingly pressed against the first base plate by spring elements and a contiguous refractory spout sleeve contained in the housing frame. The case has a second base plate juxtaposed to the first base plate and displaceable inside the housing frame at a right angle to the direction of movement of the sliding unit from an initial position in which the first base plate is in an operating position towards a final position in which the second base plate is in the operating position. It is therefore possible to replace the base plate, which wears outs quickly, by a new base plate in a rapid and convenient manner without interrupting the casting operation.

23 Claims, 4 Drawing Sheets

SLIDING CLOSURE FOR A RECEPTACLE CONTAINING MOLTEN METAL

FIELD OF THE INVENTION

The invention relates to a sliding closure for a receptacle containing molten metal, comprising a housing frame that can be fastened to a spout of the receptacle for holding a refractory base plate and a sliding unit having a refractory sliding plate that can be sealingly pressed against the base plate by means of spring elements, and the sliding unit being movable to and fro by means of a drive element.

BACKGROUND OF THE INVENTION

A sliding closure of this type is described in publication EP 0 819 488 B1. It is preferably used for opening and closing the spout opening of converters. During casting operation its refractory parts are subjected to a high degree of wear. It is therefore necessary to change them relatively frequently. However, one can only make the change by dismantling the sliding closure. Therefore the productivity of the facility is compromised due to the resulting shutdown times. This is particularly the case when using the sliding closure in converters because here, as experience has shown, the base plate wears out quickly, and so one needs to change it relatively often, and in any is case more frequently than the other refractory parts.

The object forming the basis of the invention is to avoid these disadvantages and to produce a sliding closure of the type specified at the start and which enables rapid and convenient exchange of the refractory parts particularly prone to wear, without it being necessary to interrupt the casting operation for this purpose.

OBJECTS AND SUMMARY OF THE INVENTION

This object is achieved according to the invention in that the case has a second base plate juxtaposed to the base plate and can be displaced within the housing frame at a right angle to the direction of movement of the sliding unit from an initial position in which the base plate is in an operating position towards a final position in which the second base plate adopts the operating position.

In this way it is possible to remove the worn out base plate from the operating position by displacing the case, and to overlay the latter with the second base plate without one having to dismantle the sliding closure for this purpose, and so having to discontinue the casting operation. In this way the shutdown times are reduced, and the efficiency of the facility is increased.

In order to simplify the changeover process the invention makes provision such that the case with the base plate and the second base plate can be displaced to and fro between its initial position and its final position. Here the displacement path is disposed either on one side to the left or to the right of the sliding unit, or on both sides to the left and to the right of the sliding unit.

In order to position and fix the plates securely in the case carrying them, according to the invention said case has edgings with a staggered profile in which the base plate and the second base plate can be inserted without any play.

The case can advantageously be displaced within a two-part carrying plate of the housing frame which is provided with staggered guide profiles for guiding the case in the direction of displacement. In this way, when changing the plate the precise positioning of the second base plate in the operating position is guaranteed.

In order to facilitate the changeover procedure the invention makes provision such that the case can be displaced by a transverse drive attached to the receptacle with a push rod pushing the case. Advantageously the push rod can be coupled to the case, the latter than being displaceable to and fro by the transverse drive.

Within the context of easy displaceability of the case it is advantageous if the push rod of the transverse drive acts upon the case level with the passage opening of the base plate or the second base plate.

In a structurally simple version the transverse drive is in the form of a manual drive which is provided with an operating lever for the push rod.

In a second version the transverse drive is in the form of a hydraulic linear drive the push rod of which is operated by a hydraulic cylinder. This embodiment offers easier manipulation.

With both versions the transverse drive is mounted securely on the base plate so that when dismantling the sliding closure it remains behind fixed onto the receptacle.

According to the invention the housing frame of the sliding closure has suspension and fixing means for releaseably fastening the housing frame to the base plate of the receptacle. In this way the sliding closure can be removed from the receptacle and be fixed to the latter easily, the fixing at the same time guaranteeing the tightness of the device.

In order to facilitate the installation and dismantling of the sliding closure it is advantageous if the drive element for the sliding unit is attached to the base plate and the sliding unit can be coupled to the drive element by means of a releaseable coupling.

According to the invention the case is formed with two edgings lying close alongside one another for play-free holding of the octagonal base and second base plate, the longitudinal edges of the case being provided with a staggered guide profile. This type of case can also be fitted subsequently in the sliding closures provided without any great complexity.

BRIEF DESCRIPTION OF THE DRAWINGS

In the following the invention is described in greater detail by means of an exemplary embodiment with reference to the drawings. These show as follows.

DETAILED DESCRIPTION OF THE INVENTION

Figure 1:
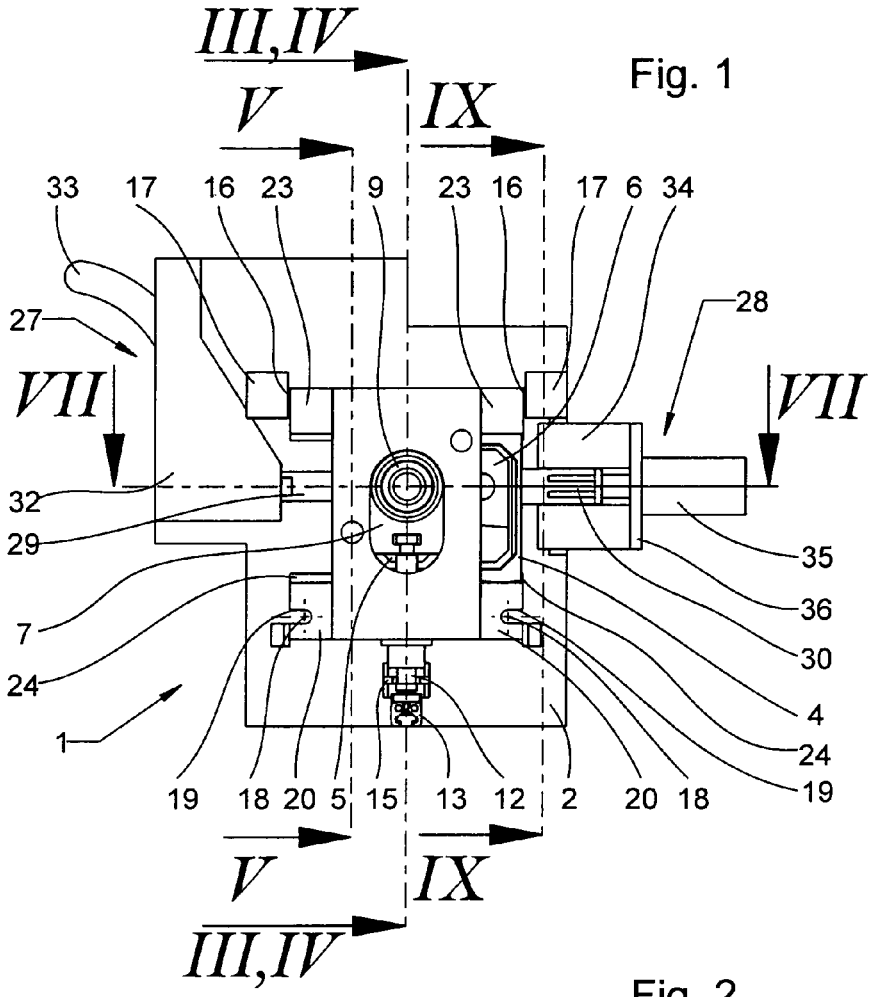
FIG. 1 is a sliding closure according to the invention shown in the top view.
Figure 2:
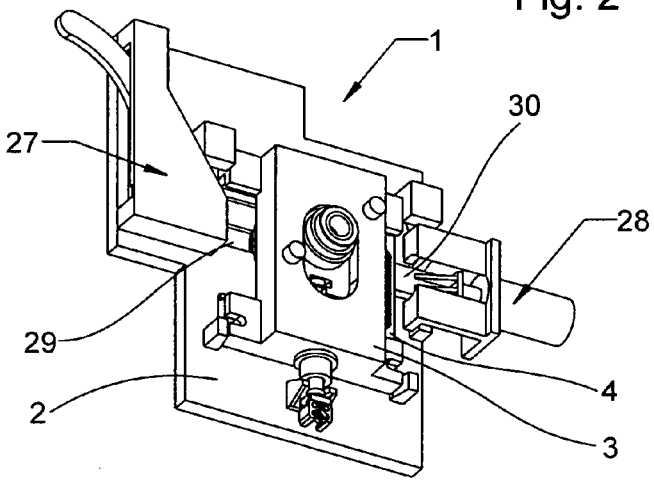
FIG. 2 is the sliding closure from FIG. 1, shown scaled down and perspectively.
Figure 3:
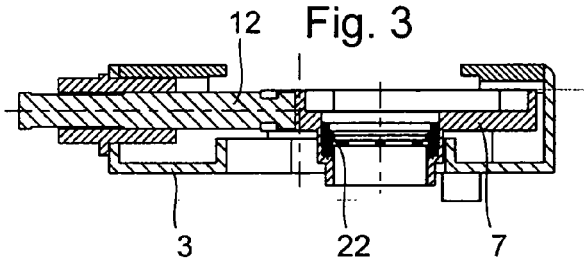
FIG. 3 is a section through the housing frame along line III-III in FIG. 1.

The sliding closure 1 according to FIGS. 1 to 9 is disposed on the spout of a converter of which only one base plate 2 carrying the sliding closure 1 can be seen in the figures.

The sliding closure 1 has a housing frame 3 with a case 4 in which a refractory base plate 5 and a likewise refractory second base plate 6 are placed. Furthermore, a sliding unit 7 with a refractory sliding plate 8 and a refractory spout sleeve 9 attached to the latter are disposed within the housing frame 3.

Figure 4:
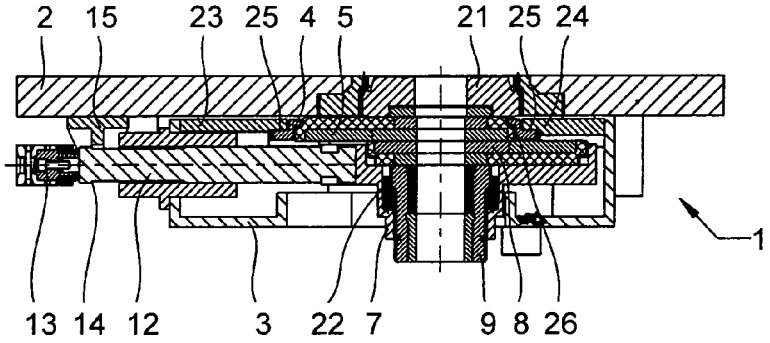
FIG. 4 is a section through the sliding closure along line IV-IV in FIG. 1, shown in the open position.
Figure 5:
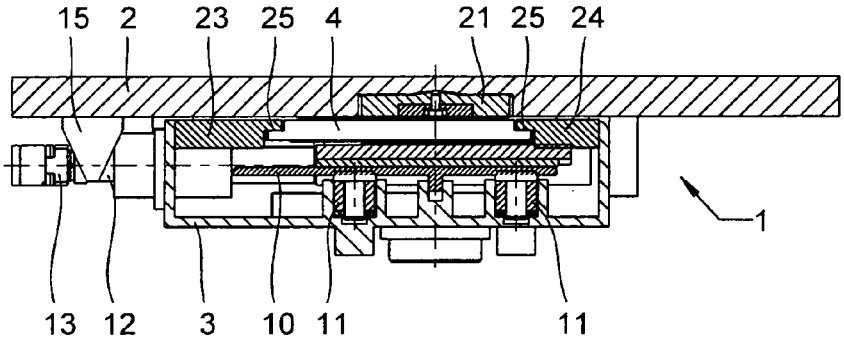
FIG. 5 is a section through the sliding closure along line V-V in FIG. 1.
Figure 6:
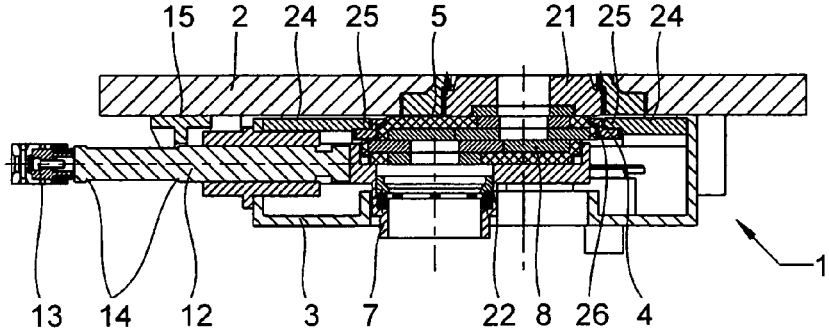
FIG. 6 is the section according to FIG. 4, shown in the closed position.

The sliding unit 7 can be displaced between the open position according to FIG. 4 and the closed position according to FIG. 6 on lateral slide rails 10 which are held within the housing frame 3 and are acted upon by spring elements 11. The sliding unit 7 is operated by a push rod 12 coupled to it which in turn can be connected by a releaseable coupling 13 to a cylinder piston drive (not shown). In order to limit the stroke there is provided on the base plate 2 a stop flange 15 which interacts with annular surfaces 14 of the push rod 12.

The housing frame 3 with the case 4 and the sliding unit 7 is suspended on the face side of the base plate 2 by means of pins 16 which project into holders 17 of the base plate. In order to fix the housing frame 3 to the base plate attachment elements 18 in the form of threaded bolts are provided in said base plate on the opposite side which can be pivoted into grooves 19 of two lateral flanges 20 of the housing frame 3. The latter is clamped securely against the base plate 2 with nuts screwed onto the threaded bolts over the flanges 20.

In the base plate 2 a disc-shaped refractory head part 21 is provided as a continuation of the spout (not shown) of the converter. In the braced state of the sliding closure 1, as shown, a power flow extending at a right angle through the sliding unit 7 and the sliding and base plates 8 and 5 lying on top of one another to the head part 21 is generated that guarantees that no molten steel can flow out between the plates 8, 5 and the head part 21 during the casting process. The spout sleeve 9 is sealingly pressed against the sliding plate 8 by a spring-loaded carrying ring 22.

The case 4 with the base plate 5 and the second base plate 6 is formed by a is rectangular steel plate which can be displaced within a two-part carrying plate 23, 24 of the housing frame 3 at a right angle to the direction of displacement of the sliding unit 7. On its longitudinal edges the case 4 has staggered guide profiles which interact with correspondingly formed guide profiles 25 of the two-part carrying plate 23, 24. In this way the case 4 is guided securely within the carrying plate 23, 24 in the direction of displacement. Moreover, the effect of the staggered form of the profiles is that the case does not fall out of the housing frame.

The case 4 has two edgings 26 lying closely alongside one another into which the base plate 5 and the second base plate 6 are inserted without any play. The edgings 26 are formed octagonally to correspond with the outer contour of the plates 5 and 6. In this way non-dislocatable positioning of both plates is guaranteed. The edgings 26 have a staggered profile matched to the outer contour of the plates 5 and 6, and this prevents the plates from falling out of the housing frame.

Figure 7:
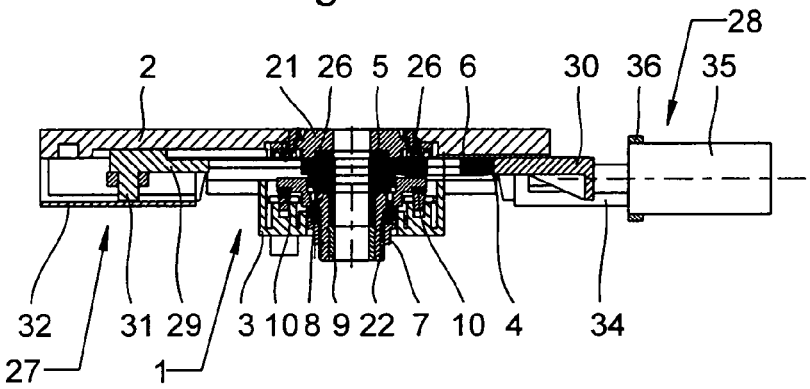
FIG. 7 is a section through the sliding closure along line VII-VII in FIG. 1, shown in the initial position of the case.
Figure 8:
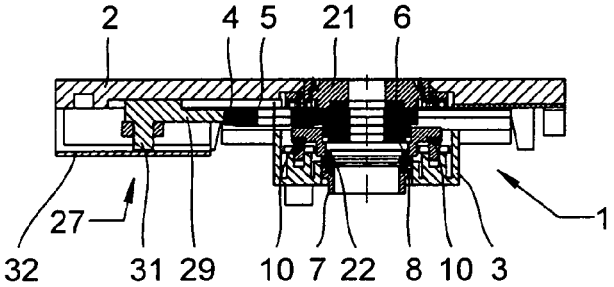
FIG. 8 is the section according to FIG. 7, in the final position of the case.
Figure 9:
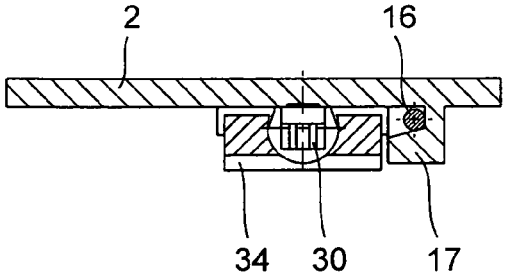
FIG. 9 is a section through the hydraulic linear drive of the case along line IX-IX in FIG. 1.

The case 4 can be displaced between the initial position shown in FIG. 7, in which the base plate 5 is in the operating position, and a position shown in FIG. 8, in which the second base plate 6 adopts the operating position. For this a transverse drive is provided. In a first embodiment the latter is in the form of a manual drive 27, and in a second embodiment is in the form of a hydraulic cylinder piston drive 28. The transverse drive 27 is mounted on the base plate 2 and provided with a push rod 29 or 30 which acts upon the case 4 level with the through hole of the base plates 5 and 6. However, this respective transverse drive 27 or 28 could also be brought into position independently of the base plate 2 so as to then be able to implement displacement of the case with the base plates.

With the manual transverse drive 27 the push rod 29 is driven by an operating lever 33 acting upon a pin 31 of the push rod and which is mounted in a box 32 attached to the base plate 2 and projects from the box to the side in order to enable manual operation.

With the hydraulic transverse drive 28 the push rod 30 is guided in a holder 34 which has a flange 36 to which the hydraulic cylinder 35 of the hydraulic transverse drive is attached.

With both versions of the drive the respective push rod 29 and 30 is not coupled to the case 4, and so it can only displace the case in one direction. However, within the framework of the invention it is easily possible to connect the push rod 29 or 30 to the case 4 by means of a releaseable coupling so that with a closed coupling the case 4 can be displaced in both directions by the transverse drive 27 or 28, whereas with an open coupling one can dismantle the sliding closure 1 released from the transverse drive attached to the base plate 2.

The sliding closure 1 according to the invention makes it possible to change the base plate 5 after reaching its maximum permissible wear without it being necessary to interrupt the casting operation for this purpose. For this purpose the case 4 is displaced with the aid of the transverse drive 27 or 28 at a right angle to the direction of movement of the sliding unit 7 to such an extent that the worn base plate 5 has vacated the operating position shown in FIG. 7 and the second base plate 6 adopts said position. Since the plate changeover takes place here while maintaining the power flow generated by the spring elements 11 it is guaranteed that the sliding closure continues to provide a perfect seal both during the plate changeover and afterwards.

Since the plate changeover is implemented without the sliding closure having to be dismantled for this purpose, with the sliding closure according to the invention it is possible at any time to change the base plate quickly and with easy execution. This is advantageous during casting operation, especially with converters, because it has been learnt from experience that with the latter the base plate wears more quickly than the other refractory parts of the device. In this way it is possible to maintain the casting operation for a longer period of time until the other refractory parts are also due for change.

In order to change these parts the sliding closure 1 is removed in the known way from the base plate 2 of the holder carrying it. For this purpose the fixing means 18 which act upon the flanges 20 of the housing framing 3 are initially released. In this way the tension force of the spring elements 11 acting upon the refractory parts is eliminated. Next the pins 16 are removed from the bearing blocks 17, and the sliding closure 1 is conveyed by means of a manipulator (not shown) to a station in which the worn refractory parts, including the base and second base plate, takes place. During this operation the case 4 can be removed effortlessly from the housing frame 3 so as to easily reach the refractory parts lying beneath them.

During installation and dismantling of the sliding closure of the converter the housing frame 3 is pivoted away from the base plate 2 together with the base plates, the sliding plate and the spout sleeve located within it. The refractory parts can then for example be removed from this housing frame and be replaced. It is desirable each time these refractory parts are changed to also change the refractory head part 21 remaining in the base plate 2 so that with a subsequent displacement of the base plates it is guaranteed that perfect tightness is guaranteed between the latter and the head part.

Before the housing frame 3 is pivoted in a contact pressure is generated on the refractory parts disposed therein by a pressure spring 9' disposed in the sliding unit 7 and surrounding the spout sleeve 9 such that the refractory parts are compressed lightly against one another, and so are not loose or can not move within the housing frame.

Figure 10:
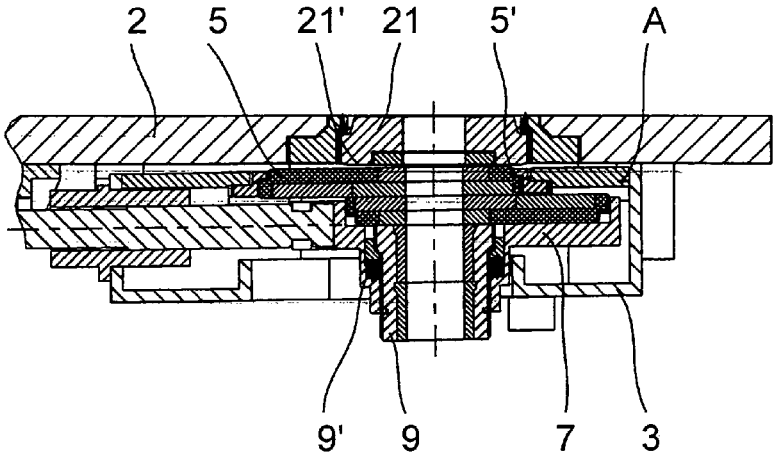
FIG. 10 is a longitudinal section of the sliding closure when pivoting onto a converter.

In FIG. 10 it is illustrated how the housing frame 3 is mounted on the base plate 2 with the refractory parts mounted in the latter by this housing frame being pivoted about the axis A formed by the pins 16 and is consequently fixed by the attachment elements 18 on this base plate 2. By means of the spring elements 11 within the housing frame the refractory parts, as explained above, are braced against one another for the intended seal.

These spring elements 11 are provided within the framework of the invention with is a spring characteristic curve such that in the pivoted in position of the housing frame 3, as shown, with which the base plate 5 comes into contact with its one face edge 5' with the lower face surface 21' of the head part 21, very slight contact forces take effect, by means of which damage to these refractory parts normally made of ceramic material is to be prevented. If the base plate 5 lies two-dimensionally against this face surface 21', another linear movement of the housing frame takes place until it is in line with the base plate 2 of the converter, and then the full spring force of the spring elements 11 is effective.

Figure 11:
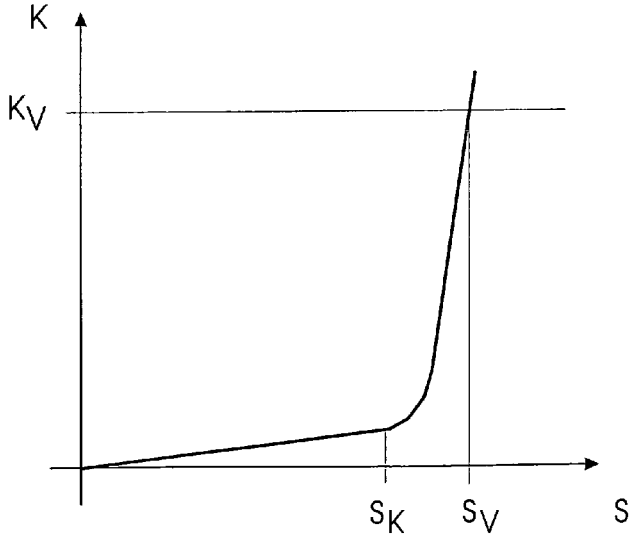
FIG. 11 is a force/path diagram of the spring elements in the sliding closure to bracing of the latter.

This is made clear in the force/path diagram of the spring elements 11 according to FIG. 11. In the abscissa two positions of the spring displacement stroke s are drawn in, namely position $s_K$ with which the contact of the base plate face edge 5' with the lower face surface 21' of the head part 21 takes place, then the stroke position $s_V$ with which the base plate 5 lies two-dimensionally against the head part 21 and the housing frame 3 on the base plate 2, in this position the defined contact force $K_V$ taking place according to the ordinate of the spring force K.

The sliding closure 1 described is equipped with a single transverse drive 27 or 28. However, it is obviously possible within the framework of the invention to provide the sliding closure with two transverse drives disposed to the left and to the right which enable operation of the case 4 in both directions without one having to couple the push rods of the transverse drives to the case.

Moreover, it is needless to say possible within the framework of the invention to use oval or differently shaped base plates instead of octagonal base plates, in this case the edgings of the case also being matched to the plate contour. Needless to say, more than two base plates could of course be disposed alongside one another.

The case according to the invention with the associated transverse drive can also be fitted subsequently into existing sliding closure devices of the type specified at the start without any great complexity.

The invention claimed is:

1. A sliding closure for a receptacle containing molten metal, the receptacle including a receptacle base plate and a refractory head part arranged in the receptacle base plate, the sliding closure comprising:

a housing frame fastenable to a spout of the receptacle;

a movable sliding unit held by the housing frame, the sliding unit having a refractory sliding plate, the sliding unit being movable in a first direction from an open position in which an aperture in the sliding plate aligns with an aperture in the head part to a closed position in which the aperture in the sliding plate does not align with the aperture in the head part and in a second direction opposite to the first direction from the closed position to the open position;

a case including a plurality of refractory base plates arranged alongside one another, only one of the refractory base plates in the case being situated in an operating position in a molten metal flow path defined by the sliding closure at any time, the housing frame holding the refractory base plate in the operating position;

the refractory base plate in the operating position being adjacent the head part of the receptacle base plate on one side and adjacent the sliding plate on an opposite side;

the case being displaceable at least partly within the housing frame while the housing frame is fastened to the spout of the receptacle to cause the refractory base plate in the operating position to be displaced out of the molten metal flow path defined by the sliding closure and replaced by another one of the refractory base plates in the case while the sliding unit is in the open position; and at least one spring element for pressing the sliding plate against the refractory base plate in the operating position and causing the refractory base plate in the operating position to be pressed toward the head part of the receptacle base plate.

2. The sliding closure according to claim 1, wherein the case is laterally displaceable in opposite directions between an initial position and a final position.

3. The sliding closure according to claim 1, wherein the case has edgings with a staggered profile in which the refractory base plates are insertable without any play.

4. The sliding closure according to claim 1, wherein the housing frame further includes a two-part carrying plate, the case being displaceable within the carrying plate in a direction perpendicular to a direction of movement of the sliding unit.

5. The sliding closure according to claim 4, wherein the sliding unit includes staggered guide profiles for guiding the case in a direction of displacement.

6. The sliding closure according to claim 1, further comprising:

a transverse drive that laterally displaces the case, the transverse drive being attachable to the receptacle; and a push rod for pushing the case.

7. The sliding closure according to claim 6, wherein the push rod is coupled to the case, and the case is displaceable by means of the transverse drive.

8. The sliding closure according to claim 6, wherein the push rod acts upon the case at a level which is the same as a level of the refractory base plate in the operating position or the another one of the refractory base plates that replaces the refractory base plate in the operating position.

9. The sliding closure according to claim 1, further comprising a spout sleeve attached to the sliding plate, the housing frame being configured to hold the sliding plate and the spout sleeve.

10. The sliding closure according to claim 9, further comprising a pressure spring arranged in the sliding unit and configured to generate contact pressure on the spout sleeve.

11. The sliding closure according to claim 1, further comprising suspension means and fixing means associated with the housing frame for releasably attaching the housing frame to the receptacle base plate.

12. The sliding closure according to claim 1, wherein the at least one spring element has a spring characteristic curve such that, in a pivoted-in position of the housing frame, a face edge of the refractory base plate in the operating position comes into contact with a lower face surface of the head part and very slight contact forces take effect.

13. The sliding closure according to claim 1, wherein the case includes two edgings lying closely alongside one another for holding, without any play, the refractory base plates, longitudinal edges of the case being provided with a staggered guide profile.

14. The sliding closure according to claim 1, wherein the case is configured to be displaceable in a direction perpendicular to a direction of movement of the sliding unit.

15. The sliding closure according to claim 1, wherein the at least one spring element comprises a plurality of spring elements.

16. The sliding closure according to claim 1, further comprising a pressure spring arranged in the sliding unit and configured to generate contact pressure on the refractory base plate in the operating position.

17. The sliding closure of claim 1, further comprising a releasable coupling for coupling the sliding unit to a drive element that moves the sliding unit, the drive element being attachable to the receptacle base plate.

18. A sliding closure for a receptacle containing molten metal, the receptacle including a receptacle base plate and a refractory head part arranged in the receptacle base plate, the sliding closure comprising:

a housing frame fastenable to the receptacle base plate;

a movable sliding unit held by the housing frame, the sliding unit having a refractory sliding plate, the sliding unit being movable in a first direction from an open position in which an aperture in the sliding plate aligns with an aperture in the head part to a closed position in which the aperture in the sliding plate does not align with the aperture in the head part and in a second direction opposite to the first direction from the closed position to the open position, a displaceable case including a first refractory base plate and a second refractory base plate juxtaposed to the first refractory base plate, the case being displaceable at least partly within the housing frame to cause the first refractory base plate to be displaced from an operating position in a flow path of molten metal from the receptacle and replaced by the second refractory base plate which assumes the operating position in the molten metal flow path, the case being configured to be displaceable in a direction perpendicular to a direction of movement of the sliding unit, the first refractory base plate being adjacent the head part of the receptacle base plate on one side and adjacent the sliding plate on an opposite side when in the operating position and the second refractory base plate being adjacent the head part of the receptacle base plate on one side and adjacent the sliding plate on an opposite side when in the operating position; and at least one spring element for pressing the sliding plate against the one of the first or second refractory base plate in the operating position and causing the first or second refractory base plate in the operating position to be pressed toward the head part of the receptacle base plate.

19. The sliding closure according to claim 18, wherein the at least one spring element comprises a plurality of spring elements.

20. The sliding closure according to claim 18, further comprising a transverse drive that displaces the case, the drive being attached to the receptacle.

21. The sliding closure according to claim 18, wherein the one of the first or second refractory base plate in the operating position is in contact with the head part.

22. The sliding closure of claim 18, further comprising a pressure spring arranged in the sliding unit and configured to generate contact pressure on the one of the first or second refractory base plate in the operating position.

23. The sliding closure of claim 18, further comprising a releasable coupling for coupling the sliding unit to a drive element that moves the sliding unit, the drive element being attachable to the receptacle base plate.

* * * * *